US011415395B1

(12) United States Patent
Higgins, Jr.

(10) Patent No.: US 11,415,395 B1
(45) Date of Patent: Aug. 16, 2022

(54) BALLISTIC SHIELD AND METHOD OF MANUFACTURE

(71) Applicant: David Wayne Higgins, Jr., Bluffdale, UT (US)

(72) Inventor: David Wayne Higgins, Jr., Bluffdale, UT (US)

(73) Assignee: CORNER EDGE TECHNOLOGIES, Bluffdale, UT (US)

( * ) Notice: Subject to any disclaimer, the term of this patent is extended or adjusted under 35 U.S.C. 154(b) by 0 days.

(21) Appl. No.: 17/375,912

(22) Filed: Jul. 14, 2021

(51) Int. Cl.
*F41H 5/08* (2006.01)
*F41H 5/04* (2006.01)

(52) U.S. Cl.
CPC ..... *F41H 5/08* (2013.01); *F41H 5/0407* (2013.01)

(58) Field of Classification Search
CPC . F41H 5/0407; F41H 5/08; F41H 5/14; F41H 5/26
See application file for complete search history.

(56) References Cited

U.S. PATENT DOCUMENTS 6,497,966 B2 12/2002 Cohen
6,630,235 B2 10/2003 Oshima et al.
6,675,550 B1 1/2004 Dlubak
8,215,223 B2 7/2012 Lucuta et al.
8,544,376 B2 10/2013 Carberry et al.
8,590,439 B2 11/2013 White et al.
10,782,103 B2 9/2020 Waldrop
2007/0283801 A1 12/2007 Gallo
2015/0024184 A1* 1/2015 Bertolini ..... B32B 17/10788 428/430
2018/0229480 A1* 8/2018 Chung ..... C09J 5/06
2020/0282707 A1* 9/2020 Lee ..... F41H 5/0471
2020/0309486 A1 10/2020 McKenna

* cited by examiner

*Primary Examiner* — J. Woodrow Eldred
(74) *Attorney, Agent, or Firm* — Danny Y. H. Cheng

(57) ABSTRACT

There is a ballistic shield and a method of manufacture thereof, including a first ballistic shield plate having a first double-layered UV protective film bonded to a first side and forming an exterior surface thereof. The ballistic shield also includes a second ballistic shield plate having a first side, wherein the first side is fastened to the first side of the first ballistic shield plate. The second ballistic shield plate includes a second double-layered UV protective film, bonded to a first side thereof and forming an exterior surface thereof. The ballistic shield further includes a mechanical fastener fastening the first ballistic shield plate to the second ballistic shield plate such that the first double-layered UV protective film is fixedly coupled against the second double-layered UV protective film without requiring bonding therebetween.

19 Claims, 7 Drawing Sheets

BALLISTIC SHIELD AND METHOD OF MANUFACTURE

FIELD OF THE INVENTION

The present invention relates to protective ballistic shields, specifically a ballistic shield and a method of manufacture thereof.

DESCRIPTION OF THE RELATED ART

Ballistic shields or tactical shields are protection devices deployed by police and military forces that are designed to stop or deflect bullets and other projectiles fired at their carrier. Ballistic shields will also protect from less serious threats such as thrown items, though they are typically used in situations where riot shields would not offer adequate protection.

Ballistic shields may be made out of materials such as UHMWPE or pre-preg aramid fibers. They may have features such as clear armored viewing ports, ambidextrous handles and spotlights for use at night, and may be either handheld or mounted on wheel-based frames. They vary in size, with some being designed to protect only the upper torso and others designed to protect the whole body. Unlike a ballistic vest, projectiles successfully stopped by a ballistic shield will not transfer trauma or pain to the bearer, as they are designed to not be in direct contact with the body.

Shields small enough to be carried by a single person may be termed "personal shields", and may be carried in police cars in the United States as standard equipment. Whether or not a shield is used will depend on both policy and the individual situation. It may be the policy of a police force to use shields only in defensive situations, such as establishing a perimeter and waiting for reinforcements, while others may permit their usage in offensive situations, such as vehicle stops that are considered high risk or approaching a suspect deemed to be dangerous.

Recommended features of ballistic shields for police include a carrying system that allows it to be held long-term without fatigue, and the ability to both reload a handgun while holding the shield and also fire it accurately with one hand. The carriage of a ballistic shield in one hand will limit both the types of firearms that may used with the other hand as well as certain methods of shooting.

An important aspect of a ballistic shield includes the capacity to actually stop/deflect bullets and other projectiles. Accordingly, the structure of the shield and the materials from which it is made are very important. These shields are subject to testing and particular government and non-government standards that relate to the effectiveness of the protection provided to the user.

Some improvements have been made in the field. Examples of references related to the present invention are described below, and the supported teachings of each reference are incorporated by reference herein:

U.S. Pat. No. 6,497,966, issued to Cohen, discloses a composite, laminated armor panel (10) for absorbing and dissipating kinetic energy from projectiles (12), the panel (10) comprising a first outwardly-positioned layer (14) made of a hard material selected from a ceramic material and a metal having a Rockwell-C hardness of at least 27, an intermediate layer (16) softer than the first layer (14), made of a material selected from aluminum and metals having a Rockwell-C hardness of less than 27 and a third backing layer (18) of tough woven textile material, wherein the three layers (14,16,18) are laminated together and wrapped on at least four sides in a further tough woven textile material (20) which is bonded to the outer surfaces of the composite, laminated armor panel (10).

U.S. Pat. No. 6,630,235, issued to Oshima et al., discloses a bulletproof glass screen and a bulletproof glass screen device which are relatively light and highly workable and provide a relatively high protectiveness and transparency. The rear face of a laminated glass 2, which is the opposite of the impact side of the glass, is covered by at least one sheet of plastic fracture-proof film 3.

U.S. Pat. No. 6,675,550, issued to Dlubak, discloses a penetration resistant window includes a penetration resistant layer sandwiched between exterior and interior transparent sheets. The perimeter of the penetration resistant layer extends from the perimeters of the exterior and interior transparent sheets in a direction plane parallel with the planes of the transparent sheets. This extension allows the laminated window sheets to be mounted in a window frame such that the perimeter of the penetration resistant layer is secured within a channel in the frame, preferably by an adhesive such as silicone glue. The penetration resistant window is useful in architectural, residential and institutional applications for resisting debris penetration during hurricanes.

U.S. Pat. No. 8,215,223, issued to Lucuta et al., discloses several ceramic armor systems are provided herein. One such system is a ceramic armor system for personnel. Such system includes an integral ceramic plate, or a plurality of interconnected ceramic components providing an integral plate. The ceramic has a deflecting front surface or a flat front surface, and a rear surface. A front spall layer is bonded to the front surface of the ceramic plate. A shock-absorbing layer is bonded to the rear surface of the ceramic plate. A backing is bonded to the exposed face of the shock-absorbing layer. A second such system is a ceramic armor system for vehicles. Such system also includes an integral ceramic plate, or a plurality of interconnected ceramic components providing an integral plate. The ceramic plate has a deflecting front surface or a flat front surface, and a rear surface. A front spall layer is bonded to the front surface of the ceramic plate. A shock-absorbing layer is bonded to the rear surface of the ceramic plate. The assembly of the front spall layer, the ceramic plate, and the shock-absorbing layer is bolted to the hull of a vehicle, preferably with an air-gap, or alternatively without an air-gap.

U.S. Pat. No. 8,544,376, issued to Carberry et al., discloses a transparent armor system includes a hard face fabricated from a substantially transparent glass-ceramic material exhibiting crystalline bodies throughout the mass of the glass-ceramic material and a backing covering a rear surface of the hard face opposite an anticipated incoming projectile. The backing has a refractive index substantially matching that of the hard face such as to allow substantial transparency of the transparent armor system. The hard face serves to disburse energy caused by the impact of an incoming projectile with the transparent armor system, while the backing serves to retain any pieces of the hard face fractured during ballistic impact. In certain embodiments, a plurality of hard faces are held in parallel and spaced apart arrangement.

The inventions heretofore known suffer from a number of disadvantages which include being limited in protection, being limited in use, being limited in repeated use, being limited in rapid use, being limited in durability, being limited in vision, being difficult to use, being unreliable, being unprotective, being structurally compromised after use, being expensive, being heavy, being bulky, being difficult to use, being difficult to manufacture, being difficult to manufacture consistently, being heavy compared to their protective rating, being expensive compared to their protective rating, and requiring expensive and/or difficult manufacturing processes.

What is needed is a ballistic shield and/or method of manufacture thereof that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available ballistic shields. Accordingly, the present invention has been developed to provide a transparent protective ballistic shield able to withstand multiple and repeated ballistic projectiles without compromising the integrity of the ballistic shield.

According to one embodiment of the invention, there is a ballistic shield that may include a first ballistic shield plate. The first ballistic shield plate may include a first double-layered UV protective film bonded to a first side and may form an exterior surface thereof. The ballistic shield may also include a second ballistic shield plate that may have a first side, wherein the first side may be coupled to the first side of the first ballistic shield plate. The second ballistic shield plate may include a second double-layered UV protective film, bonded to a first side thereof and that may be forming an exterior surface thereof. The ballistic shield may further include a mechanical fastener fastening the first ballistic shield plate to the second ballistic shield plate such that the first double-layered UV protective film may be fixedly coupled against the second double-layered UV protective film without requiring bonding therebetween.

According to one embodiment of the invention, the first ballistic shield and the second ballistic shield of the ballistic shield may be transparent to light in the visible spectrum. The ballistic shield may include a handle that may be coupled to a top support bracket of the mechanical fastener. The handle may be oriented horizontally such that when grasped by a user a bottom support bracket rests on a forearm of a user. The first ballistic shield plate may be coupled to the second ballistic shield plate by fasteners extending through a plurality of holes through the first ballistic shield plate and the second ballistic shield plate that fastening a pair of support brackets to the second ballistic shield plate and the first ballistic shield plate. The ballistic shield may also include a scratch resistant UV film bonded to a second surface of the first ballistic shield plate and forming an exterior surface thereof. The ballistic shield may further include a plurality of air pockets disposed between the UV film of the first ballistic shield plate and the second ballistic shield plate.

According to one embodiment of the invention, there is a method of manufacture of a transparent ballistic shield. The method may include the step of bonding a first layer of UV film to a first ballistic plate. The method may also include the step of bonding a second layer of UV film to the first layer of UV film of the first ballistic plate. The method may include the step of bonding a first layer of UV film to a second ballistic plate. The method may include the step of bonding a second layer of UV film to the first layer of UV film of the second ballistic plate. The method may further include the step of mechanically coupling the first and second ballistic plates to each other such that the second layer of UV film of the first ballistic plate may be adjacent to the second layer of UV film of the second ballistic plate and that air may be trapped between the interface between the first and second ballistic plates.

According to one embodiment of the invention, there is a method of manufacture of a transparent ballistic shield that may include the step of drilling a plurality of holes through the first ballistic plate and the second ballistic plate and fastening the plates together. The method may include the step of attaching a top support bracket and a bottom support bracket to the second ballistic plate to couple the first ballistic shield plate to the second ballistic shield plate, wherein the top support bracket may include a handle. The method may include the step of applying a scratch resistant UV film to an exterior surface of the first ballistic plate.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
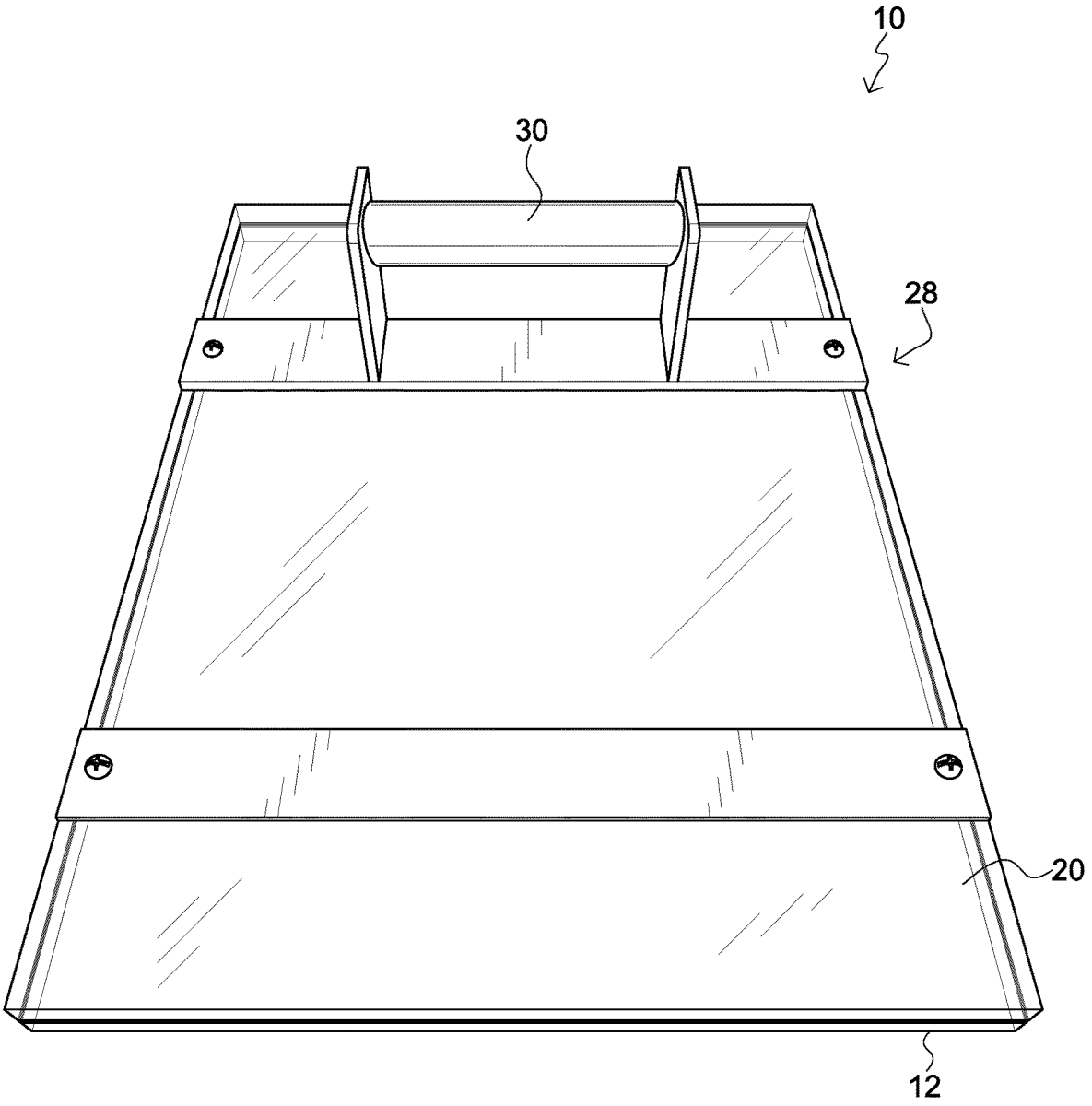
FIG. 1 is a top perspective view of a ballistic shield, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is" "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a top perspective view of a ballistic shield, according to one embodiment of the invention. There is shown a ballistic shield 10 having a first ballistic shield plate 12 and a second ballistic shield plate 20 fastened by a mechanical fastener 28 including a handle 30. The illustrated plates 12 and 20 are transparent, thereby providing visibility therethrough for the user while simultaneously providing ballistic protection thereto.

According to the illustrated embodiment of the invention, there is a ballistic shield 10 including a first ballistic shield plate 12. The first ballistic shield plate 12 may include a first double-layered UV protective film, such as, but not limited to a ballistic UV film manufactured by CJ Buffer, 150 North Draper Lane Provo, Utah 84601. The UV film is manufactured with adhesive element to attach to the polycarbonate; however, the UV film may include or not include an adhesive element and still perform its intended function. The first ballistic shield plate 12 may be made from a polycarbonate material, such as, but not limited to a Lexan clear polycarbonate, manufactured by General Electric Company, 5 Necco Street Boston, Mass. 02210. The first ballistic shield plate is shaped and sized to provide a conveniently holdable and usable barrier for a user thereof.

The ballistic shield 10 also includes a second ballistic shield plate 20 shaped and sized to substantially match the shape and size of the first ballistic shield plate 12. The second ballistic shield plate 20 may have a second double-layered UV protective film. The illustrated second ballistic shield plate 20 is facing opposite to the first ballistic shield plate 12, such that their respective coatings are adjacent and not exposed on the outer surface of the shield 10, thereby protecting those coatings from physical damage from scratching etc.

The ballistic shield 10 further includes a mechanical fastener 28 fastening the first ballistic shield plate 12 to the second ballistic shield plate 20 such that the first double-layered UV protective film is fixedly coupled against the second double-layered UV protective film without requiring bonding therebetween. The mechanical fastener may consist of a plurality of plates, bolts and nuts, rivets, clamps, and other fastener devices. The mechanical fastener may be composed of a metals, hard plastics, ceramics, and the like and composites thereof.

According to one embodiment of the invention, there is a ballistic shield 10 designed to protect a carrier of the ballistic shield 10. The ballistic shield 10 is able to withstand a projectile, such as a bullet, the ballistic shield 10 is able to withstand multiple or repeated bullets or rounds without compromising the structure.

A sample ballistic shield substantially similar to tat described herein has undergone testing by Nationwide Structures, Inc. The following charts state describe the resultant ballistic rating(s) of the sample ballistic shield.

Ratings of Bullet Resistant materials as identified by: UL 752

| | | | | | | |
|---|---|---|---|---|---|---|
| Level 1 | 9 mm Full Metal Copper Jacket with Lead Core | 124 | 8.0 | 1175 | 1293 | 3 |
| Level 2 | .357 Magnum Jacketed Lead Soft Point | 158 | 10.2 | 1250 | 1375 | 3 |
| Level 3 | .44 Magnum Lead Semi-Wadcutter Gas Checked | 240 | 55 | 1350 | 1485 | 3 |
| Level 4 | .30 Caliber Rifle Lead Core Soft Point (.30-06 Caliber) | 180 | 11.7 | 2540 | 2794 | 1 |
| Level 5 | 7.62 mm Rifle Lead Core Full Metal Copper Jacket Military Ball (.308 Caliber) | 150 | 9.7 | 2750 | 3025 | 1 |
| Level 6 | 9 mm Full Metal Copper Jacket with Lead Core | 124 | 8.0 | 1400 | 1540 | 5 |
| Level 7 | 5.56 mm Rifle Full Metal Copper Jacket with Lead Core (.223 Caliber) | 55 | 3.56 | 3080 | 33835 | 5 |
| Level 8 | 7.62 mm Rifle Lead Core Full Metal Copper Jacket Military Ball (.308 Caliber) | 150 | 9.7 | 2750 | 3025 | 5 |

-continued

Ratings of Bullet Resistant materials as identified by: UL 752

| | | | | | | |
|---|---|---|---|---|---|---|
| Level 9 | .30-06 caliber rifle, steel core, lead point filler, FMJ (APM2) | 166 | 10.8 | 2715 | 2987 | 1 |
| Level 10 | .50 caliber rifle, lead core FMCJ Military Ball (M2) | 709.5 | 45.9 | 2810 | 3091 | 1 |
| Shotgun | 12-Gauge Rifled Lead Slug 12-Gauge 00 Buckshot (12 pellets) | 1 oz<br>1.5 oz | 28.3<br>42 | 1585<br>1200 | 1744<br>1320 | 3<br>3 |

Ratings of Bullet Resistant materials as identified by: National Institute of Justice (NIJ) 018.01

| | | | | | | |
|---|---|---|---|---|---|---|
| Level I | .22 long rifel high velocity lead | 40 | 2.6 | 320 +/− 12 | 1050 +/− 40 | 5 |
| Level I | .38 special round nose lead | 158 | 10.2 | 258 +/− 15 | 850 +/− 50 | 5 |
| Level II | .357 mag. jacketed soft point | 158 | 10.2 | 425 +/− 15 | 1395 +/− 50 | 5 |
| Level II | 9 mm full metal jacket | 124 | 8.0 | 358 +/− 12 | 1175 +/− 40 | 5 |
| Leve IIA | .357 mag. jacketed soft point | 158 | 10.2 | 381 +/− 15 | 1250 +/− 50 | 5 |
| Level IIA | 9 mm full metal jacket | 124 | 8.0 | 332 +/− 12 | 1090 +/− 40 | 5 |
| Level III | 7.62 mm (.308 Winchester) full metal jacket | 150 | 9.7 | 838 +/− 15 | 2750 +/− 50 | 5 |
| Level IIIA | .44 mag. lead semi-wadcutter gas checked | 240 | 15.55 | 426 +/− 15 | 1400 +/− 50 | 5 |
| Level IIIA | 9 mm full metal jacket | 124 | 8.0 | 426 +/− 15 | 1400 +/− 50 | 5 |
| Level IV | .30-06 armor piercing | 166 | 10.8 | 868 +/− 15 | 2850 +/− 50 | 1 |

Ratings of Bullet Resistant materials as identified by: State Department SD-STD-02.01

| | | | | | | |
|---|---|---|---|---|---|---|
| SD - Minimum, 9 mm Parabellum | 9 mm Full Steel Jacket (FSJ) | 115 | 7.45 | 1350 | 1450 | 3 |
| SD - Minimum, 12 g, 2-¾" | 12 gauge, 2-¾", #4 Buck | 556 | 36.03 | 1275 | 1375 | 1 |
| SD - Rifle, .30, 7.62 NATO | (Part 1) .308 caliber, 7.52 NATO M80 | 147 | 9.53 | 2700 | 2800 | 1 |
| SD - Rifle, .223, 5.56 NATO | (Part 2) .223 cailiber, 5.56 mm NATO M193 | 55 | 3.56 | 3135 | 3235 | 1 |
| SD - Rifle, .223, 5.56 NATO | (Part 3) .233 caliber, 5.56 mm NATO M855 | 63 | 4.08 | 2950 | 2950+ | 1 |
| SD - Rifle, 12 ga, 2-¾" | (Part 4) 12 gauge, 2-¾", #4 Buck | 556 | 36.03 | 1275 | 1375 | 1 |
| SD - Rifle AP, .30, 7.62 NATO | (Part 1) .30 caliber, 7.62 mm NATO M61 AP | 150 | 9.72 | 2700 | 2800 | 3 |
| SD - Rifle AP, .30, 30-06 | (Part 1) .30-06 caliber M2AP | 165 | 10.69 | 2800 | 2900 | 3 |

Ratings of Bullet Resistant materials as identified by: ASTM F-1233

| | | | | | | |
|---|---|---|---|---|---|---|
| 9 mm Parabellum/ Submachine Gun | 9 mm Parabellum FMJ | 124 | 8.04 | 1350 | 1450 | 3 |
| .38 Super/Handgun | .38 Super FMJ | 130 | 8.42 | 1230 | 1330 | 3 |
| .44 Magnum/Handgun | .44 Magnum JSP | 240 | 15.55 | 1400 | 1500 | 3 |
| 7.62 NATO/Rifle | 7.62 mm (.308 caliber) M80 NATO | 147 | 9.53 | 2750 | 2850 | 3 |
| .30-06 Armor Piercing Rifle | .30-06 M2 AP | 165 | 10.69 | 2725 | 2825 | 3 |

-continued

Ratings of Bullet Resistant materials as identified by: ASTM F-1233

| | | | | | | |
|---|---|---|---|---|---|---|
| 12 ga. Shotshell, 3" Magnum | 12 gauge, 3" Magnum, #00 Buckshot | 808 | 52.36 | 1265 | 1365 | 3 |

Ratings of Bullet Resistant materials as identified by: HP White Laboratories HPW-TP 0500.02

| | | | | | | |
|---|---|---|---|---|---|---|
| Level A | .38 Special Round Nose Lead (RNL) | 158 | 10.24 | 700 | 800 | 3 |
| Level B | 9 mm × 19 Full Metal Jacket (FMJ) | 124 | 8.04 | 110 | 1180 | 3 |
| Level C | .44 Magnum Full Metal Jacket (FMJ) | 240 | 15.55 | 1350 | 1455 | 3 |
| Level D | 7.62 mm × 51 NATO M80 | 147 | 9.53 | 2725 | 2825 | 3 |
| Level E | .30-06 AP M2 | 165 | 10.69 | 2725 | 2825 | 3 |

Ratings of Bullet Resistant materials as identified by: European Standard DIN EN 1063

| | | | | | | |
|---|---|---|---|---|---|---|
| BR1, .22 LR | .22 LR RNL | 40 | 2.59 | 1048 | 1214 | 3 |
| BR2, 9 mm | 9 mm Luger FSJ-RNSC | 124 | 8.04 | 1280 | 1345 | 3 |
| BR3, .357 Magnum | .357 Magnum FSJ-CNSC | 158 | 10.24 | 1378 | 1444 | 3 |
| BR4, .44 Magnum | .44 Magnum FCJ-FNSC | 240 | 15.55 | 1411 | 1476 | 3 |
| BR5, 5.56 × 45 NATO AP | 5.56 mm × 45 NATO SS 109 steel penetrator | 62 | 4.02 | 3084 | 3150 | 3 |
| BR6, 7.62 × 51 NATO | 7.62 mm × 51 NATO M80 FSJ | 147 | 9.53 | 2690 | 2756 | 3 |
| BR7, 7.62 × 51 NATO AP | 7.62 mm × 51 NATO AP SHC | 150 | 9.72 | 2657 | 2723 | 3 |
| SG1/SG2, Shotgun | 12 gauge solid lead Brenneke slug | 478 | 30.97 | 1312 | 1444 | 1 |

Ratings of Bullet Resistant materials as identified by: British Standards institution BS 5051

| | | | | | | |
|---|---|---|---|---|---|---|
| BSI-G0, 9 mm Parabellum | 9 mm Parabellum FMJ | 115 | 7.45 | 1280 | 1378 | 3 |
| BSI-G1, .357 Magnum | .357 Magnum JSP | 158 | 10.24 | 1427 | 1526 | 3 |
| BSI-G2, .44 Magnum | .44 Magnum JSP | 240 | 15.55 | 1496 | 1594 | 3 |
| BSI-R1, .223, 5.56 NATO | .223 caliber, 5.56 mm NATO M885/SS109 | 63 | 4.08 | 3015 | 3114 | 3 |
| BSI-R2, .30, 7.62 | .308 caliber, 7.62 mm NATO M80 | 147 | 9.53 | 2674 | 2772 | 3 |
| BSI-S86, 12 ga. 2-¾" | 12 gauge, 2-¾" | 438 | 28.38 | 1332 | 1463 | 1 |

Ratings of Bullet Resistant materials as identified by: Councils of Standards Australia/New Zealand AS/NZ 2343

| | | | | | | |
|---|---|---|---|---|---|---|
| G0, 9 mm Parabellum | 9 mm Parabellum FMJ | 115 | 7.45 | 1294 | 1362 | 3 |
| G1, .357 Magnum | .357 Magnum SWC | 158 | 10.24 | 1467 | 1532 | 3 |
| G2, .44 Magnum | .44 Magnum SWC | 240 | 15.55 | 1568 | 1634 | 3 |
| R1, .223, 5.56 NATO | .223 caliber, 5.56 mm NATO M193 | 55 | 3.56 | 3182 | 3248 | 3 |

-continued

| Ratings of Bullet Resistant materials as identified by: Councils of Standards Australia/New Zealand AS/NZ 2343 | | | | | | |
|---|---|---|---|---|---|---|
| R2, .30, 7.62 NATO | .308 caliber, 7.62 mm NATO M80 | 147 | 7.53 | 2766 | 2831 | 3 |
| S0, 12 ga, 2-¾" | 12 gauge, 2-¾" SHOT | 493 | 31.95 | 1289 | 1355 | 3 |
| S1, 12 ga, 2-¾" | 12 gauge, 2-¾" SLUG | 382 | 24.75 | 1532 | 1598 | 2 |

| Ratings of Bullet Resistant materials as identified by: German Deutche Institut fur Normung (DIN) 52-290 | | | | | | |
|---|---|---|---|---|---|---|
| C1-SF and C1-SA, 9 mm Parabellum | 9 mm Parabellum FMJ | 124 | 8.04 | 1165 | 1198 | 3 |
| C2-SF and C2-SA, .357 Magnum | .357 Magnum FMJ | 158 | 10.24 | 1362 | 1394 | 3 |
| C3-SF and C3-SA, .44 Magnum | .44 Magnum FMJ | 240 | 15.55 | 1427 | 1460 | 3 |
| C4-SF amd C4-SA, .30, 7.62 NATO | .308 caliber, 7.62 mm NATO M80 | 147 | 9.53 | 2575 | 2608 | 3 |
| C5-SF and C5-SA, .30, 7.62 NATO | .308 caliber, 7.62 mm NATO M61 AP | 150 | 9.72 | 2625 | 2657 | 3 |

Figure 2:
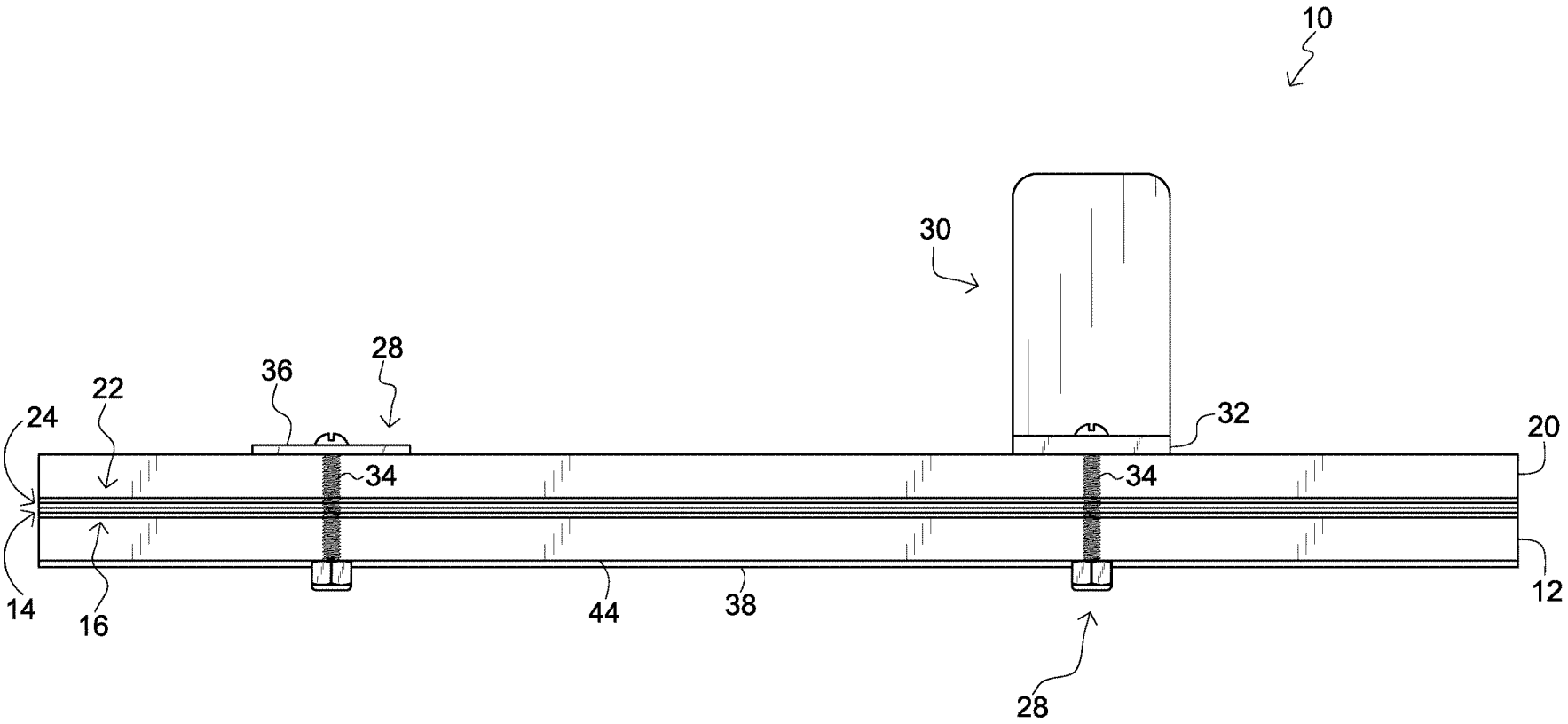
FIG. 2 is a side elevational view of a ballistic shield, according to one embodiment of the invention.

FIG. 2 is a side elevational view of a ballistic shield, according to one embodiment of the invention. There is shown a ballistic shield 10 having a first ballistic shield plate 12 and a second ballistic shield plate 20 fastened together (face to face) by a mechanical fastener 28 including a handle 30.

According to one embodiment of the invention, there is a ballistic shield 10 including a first ballistic shield plate 12. The first ballistic shield plate 12 includes a first double-layered UV protective film 14 bonded to a first side 16 and forming an exterior surface thereof. The first doubled-layered UV protective film 14 may be a ballistic UV film manufactured by CJ Buffer, 150 North Draper Lane Provo, Utah 84601. The UV protective film may be bonded by using an adhesive that is included with the UV protective film. The ballistic shield 10 also includes a second ballistic shield plate 20 having a first side 22, wherein the first side is coupled to the first side 16 of the first ballistic shield plate 12. The second ballistic shield plate 20 includes a second double-layered UV protective film 24, bonded to the first side 22 thereof and forming an exterior surface thereof. The ballistic shield 10 further includes a mechanical fastener 28 fastening the first ballistic shield plate 12 to the second ballistic shield plate 20 such that the first double-layered UV protective film 14 is fixedly coupled against the second double-layered UV protective film 24 without requiring bonding therebetween.

According to one embodiment of the invention, the illustrated ballistic shield 10 includes a handle 30 coupled to a top support bracket 32 of the mechanical fastener 28. The first ballistic shield plate 12 is coupled to the second ballistic shield plate 20 by fasteners 28 extending through a plurality of holes 34 through the first ballistic shield plate 12 and the second ballistic shield plate 20 fastening a pair of support brackets 32, 36 to the second ballistic shield plate 20 and the first ballistic shield plate 12. The ballistic shield 10 also includes a scratch resistant UV film 38 bonded to a second surface 44 of the first ballistic shield plate 12 and forming an exterior surface thereof. A non-limiting example of a scratch resistant UV film may be a ballistic UV film manufactured by CJ Buffer, 150 North Draper Lane Provo, Utah 84601.

Figure 3:
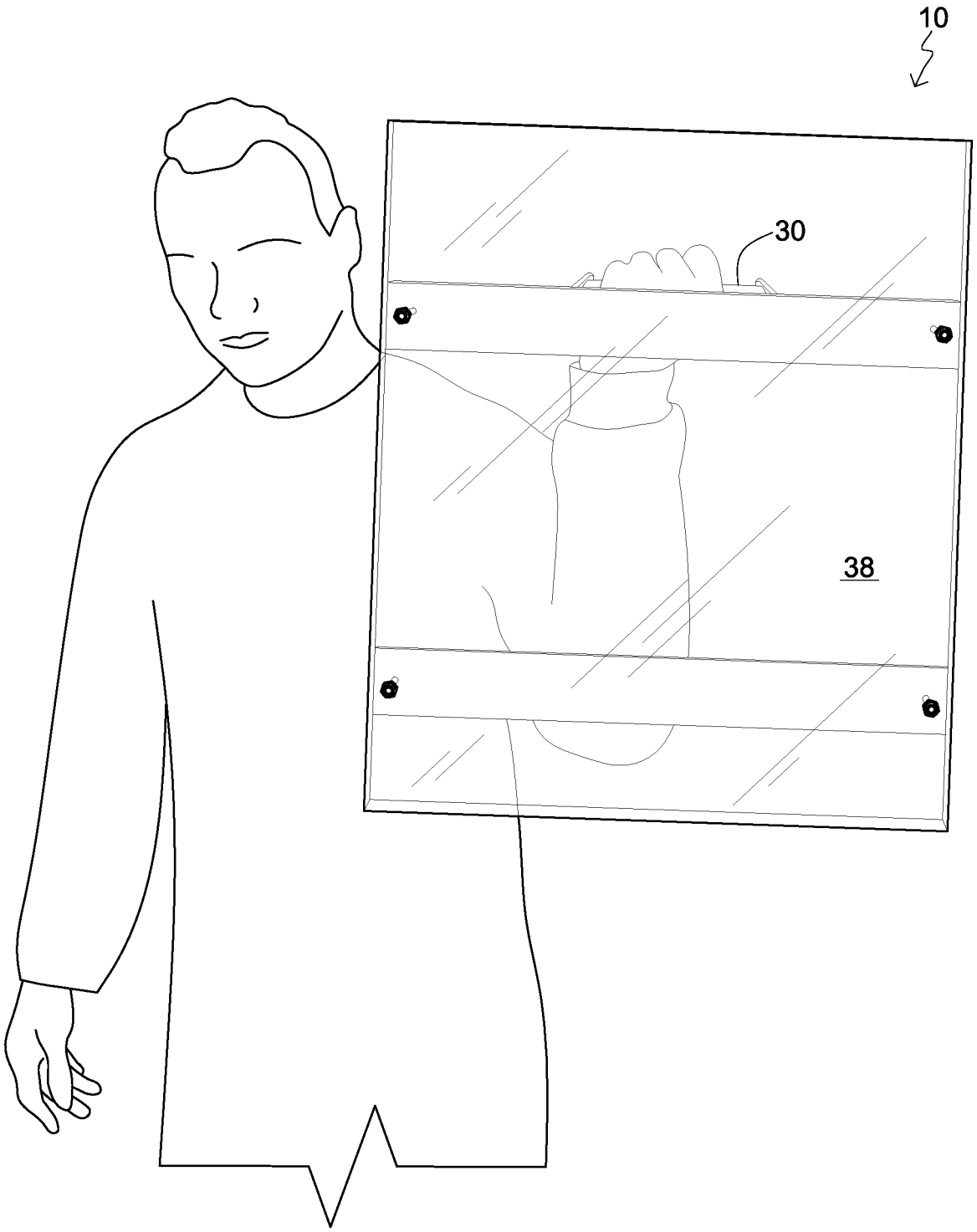
FIG. 3 is front elevational view of a ballistic shield in use, according to one embodiment of the invention.
Figure 4:
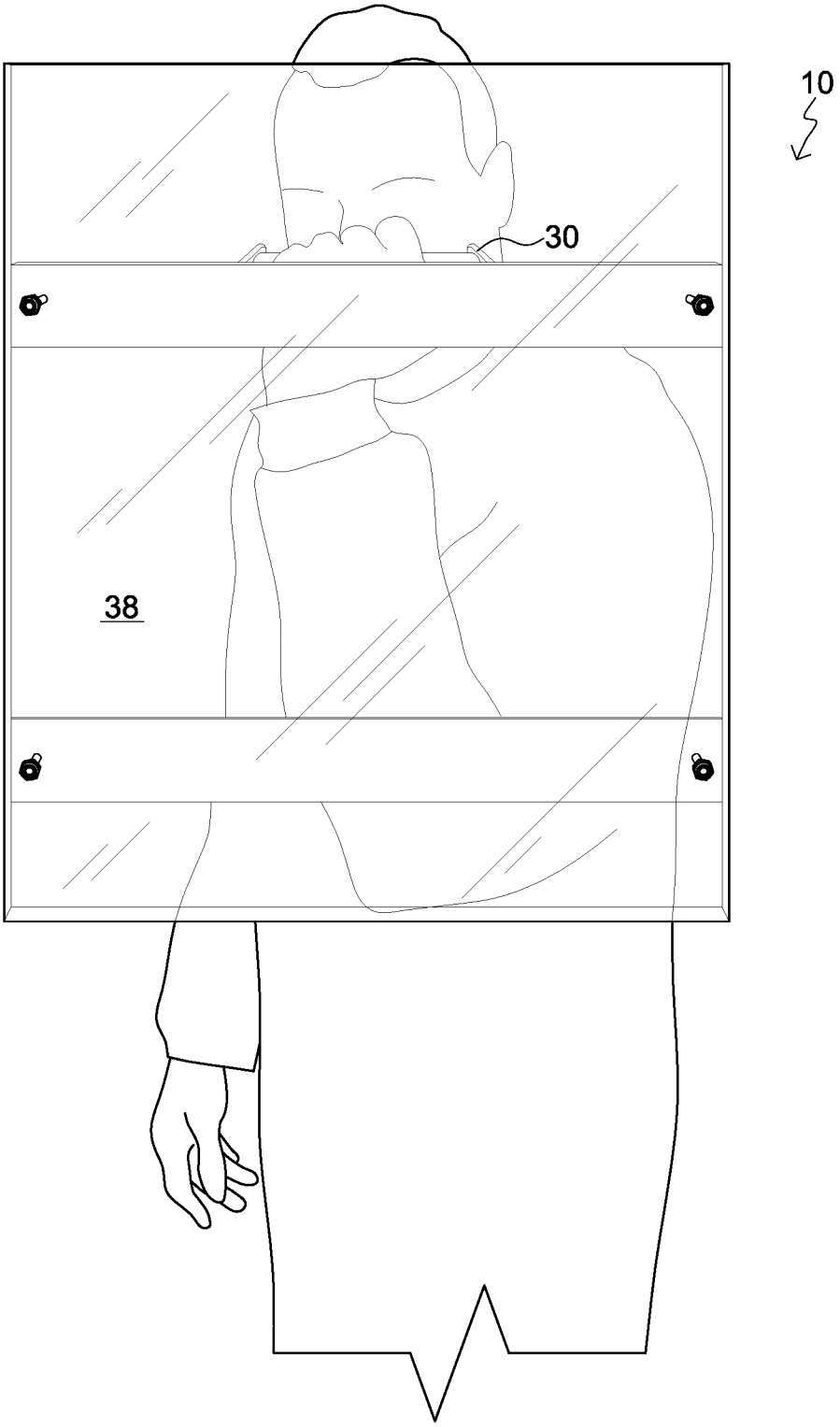
FIG. 4 is a front elevational view of a ballistic shield in use, according to one embodiment of the invention.

FIGS. 3 and 4 are both front elevational views of a ballistic shield in use, according to one embodiment of the invention. There is shown a user holding a ballistic shield 10 by a handle 30.

According to one embodiment of the invention, there is a ballistic shield 10 including a first ballistic shield plate and a second ballistic shield plate fastened together by a mechanical fastener having a handle 30. The illustrated first ballistic shield and the second ballistic shield of the ballistic shield 10 are transparent to light in the visible spectrum. The ballistic shield 10 may be between about or greater than any one/two of 85%, 90%, 95%, 98%, and 99% completely transparent. The ballistic shield 10 includes a handle 30 oriented horizontally such that when grasped by a user a bottom support bracket rests on a forearm of a user. The ballistic shield 10 also includes a scratch resistant UV film 38 bonded to a second surface of the first ballistic shield plate and forming an exterior surface thereof. The scratch resistant UV film 38 may be replaced, such as removed and reapplied to the second surface. The scratch resistant UV film 38 may be camouflaged or may include any type of design to hide the ballistic shield 10 from sight; and still be substantially transparent/translucent to the user.

According to one embodiment of the invention, there is a user grasping a handle 30 of a ballistic shield 10. The user positions the handle in front of the face and upper body protecting the major organs from damage from a projectile or bullet. The user is able to see through the ballistic shield 10 and see any on coming danger. The ballistic shield 10 is designed to take multiple or repeated rounds or bullets at close range and the integrity of the structure is not compromised; still able to protect the user behind the ballistic shield 10 from damage.

Figure 5:
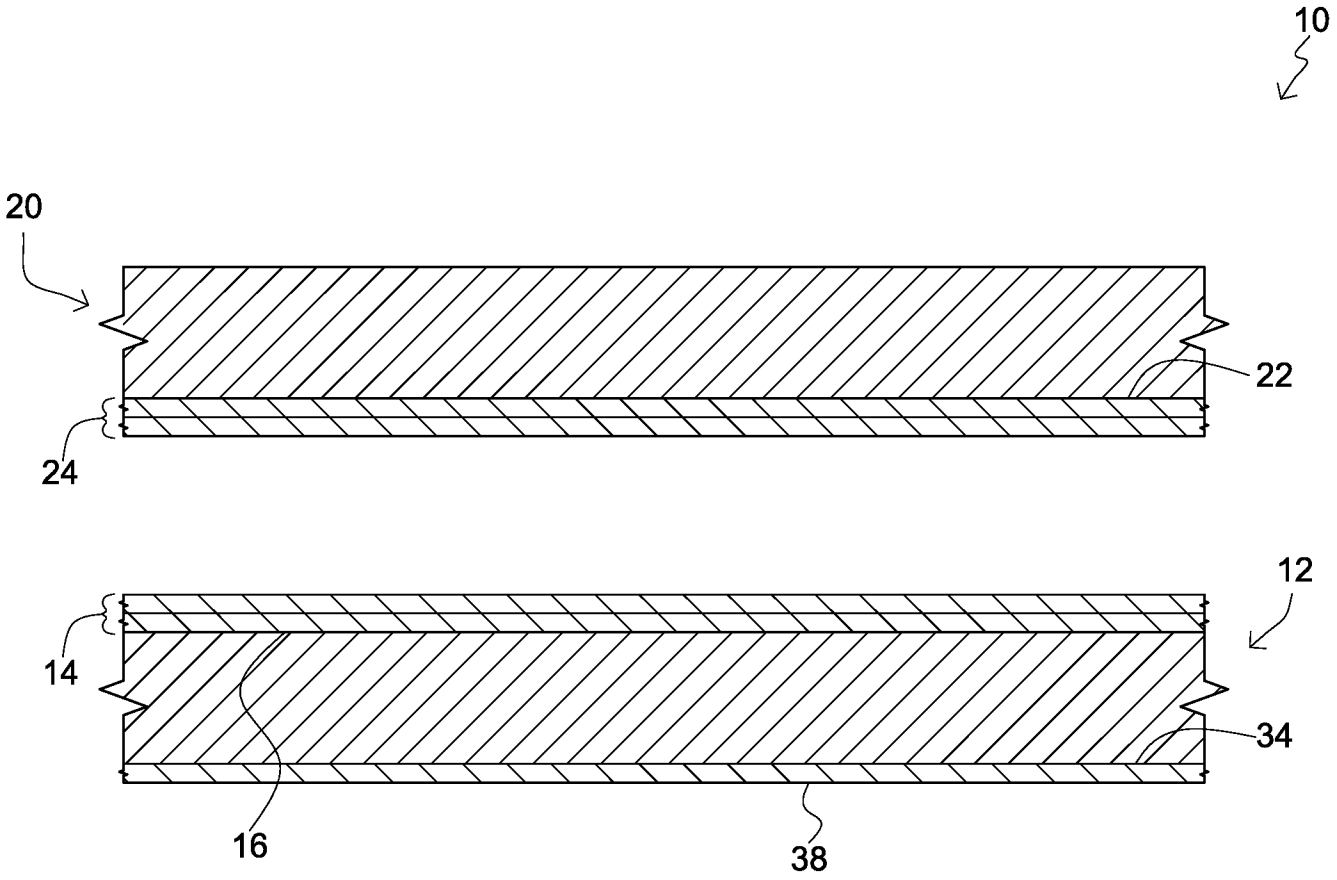
FIG. 5 is a cross-sectional view of a first ballistic shield plate proximate to but not touching a second ballistic shield plate, according to one embodiment of the invention.

FIG. 5 is a cross-sectional view of a first ballistic shield plate proximate to but not touching a second ballistic shield plate, according to one embodiment of the invention. There is shown a first ballistic shield plate 12 and a second ballistic shield plate 20 of a ballistic shield 10.

Figure 6:
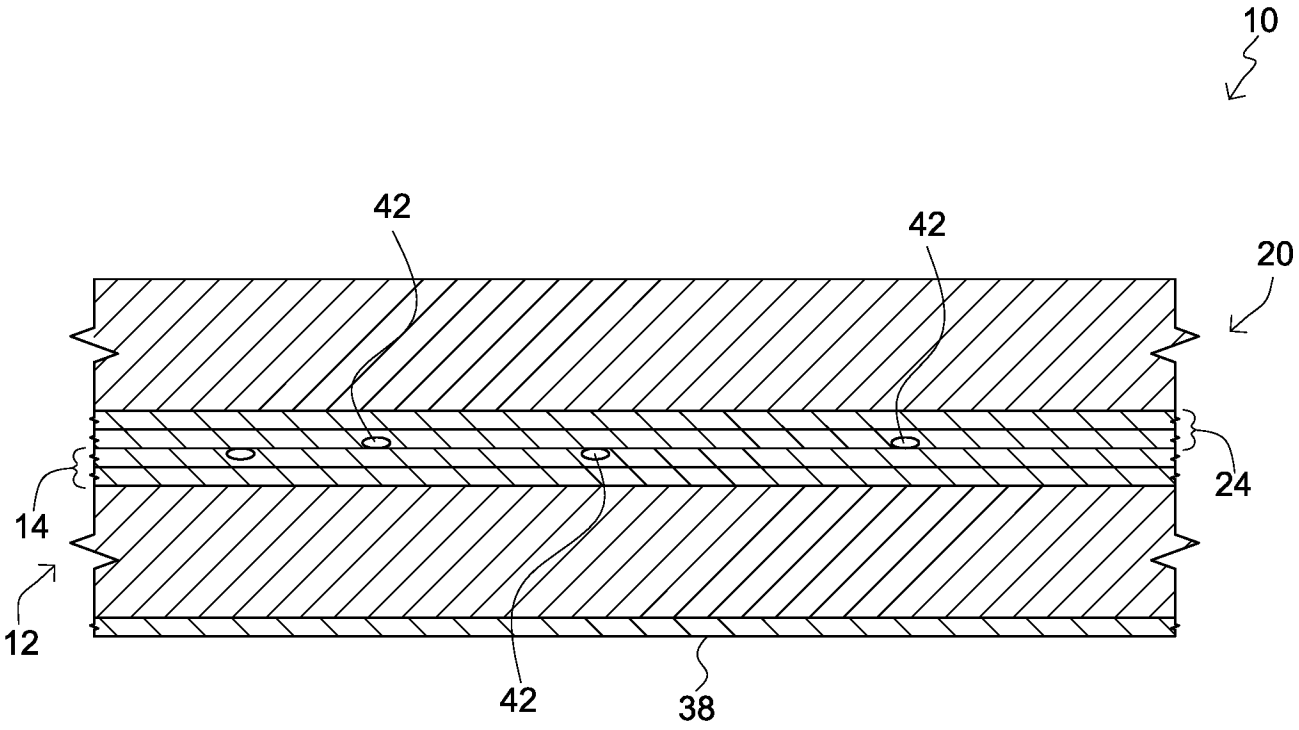
FIG. 6 is a cross-sectional view of a first ballistic shield plate coupled to a second ballistic shield plate with air pockets disposed therebetween, according to one embodiment of the invention.

FIG. 6 is a cross-sectional view of a first ballistic shield plate coupled to a second ballistic shield plate with air pockets disposed therebetween, according to one embodiment of the invention. There is shown a first ballistic shield plate 12 and a second ballistic shield plate 20 of a ballistic shield 10.

According to one embodiment of the invention, there is a ballistic shield 10 including a first ballistic shield plate 12; wherein the first ballistic shield plate 12 includes a first double-layered UV protective film 14 bonded to a first side 16 and forming an exterior surface thereof. The ballistic shield 10 also includes a second ballistic shield plate 20 having a first side 22, wherein the first side 22 is coupled to the first side 16 of the first ballistic shield plate 12. The second ballistic shield plate 20 includes a second double-layered UV protective film 24, bonded to the first side 22 thereof and forming an exterior surface thereof. The first ballistic shield plate 12 is then fastened to the second ballistic shield plate 20, by a mechanical fastener, such that the first double-layered UV protective film 14 is fixedly coupled against the second double-layered UV protective film 24 without requiring bonding therebetween.

According to one embodiment of the invention, the first ballistic shield plate 12 and the second ballistic shield plate 20, of the ballistic shield 10, are transparent to light in the visible spectrum. The ballistic shield 10 also includes a replaceable scratch resistant UV film 38 bonded to a second surface 34 of the first ballistic shield plate 12 and forming an exterior surface thereof. The ballistic shield 10 further includes a plurality of air pockets 42 disposed between the first and the second double-layered UV films, 14, 24 of the first ballistic shield plate 12 and the second ballistic shield plate 20.

According to one embodiment of the invention, the plurality of air pockets 42 are formed during the manufacturing process of the ballistic shield. When the second double-layered UV film of the second ballistic shield plate is placed upon the first double-layered UV film of the first ballistic shield plate; small air pockets are formed in between the two layers of the double-layered UV film. The first ballistic shield and the second ballistic shield are then fastened together by the fastener mechanism. The plurality of air pockets help dissipate the impact or force of the projectiles or bullets on the ballistic shield. They also provide an extra and inconsistent layer of mechanical properties that are different from the rigid layers and this produces an inconsistent and dispersive transfer of energy between the two plates, thereby reducing resonance within the shield and providing pockets of energy absorption within the shield itself. The pockets also allow for a extra degree of vibrational freedom between the two plates that further disperses impact energy from received ballistics tire.

Figure 7:
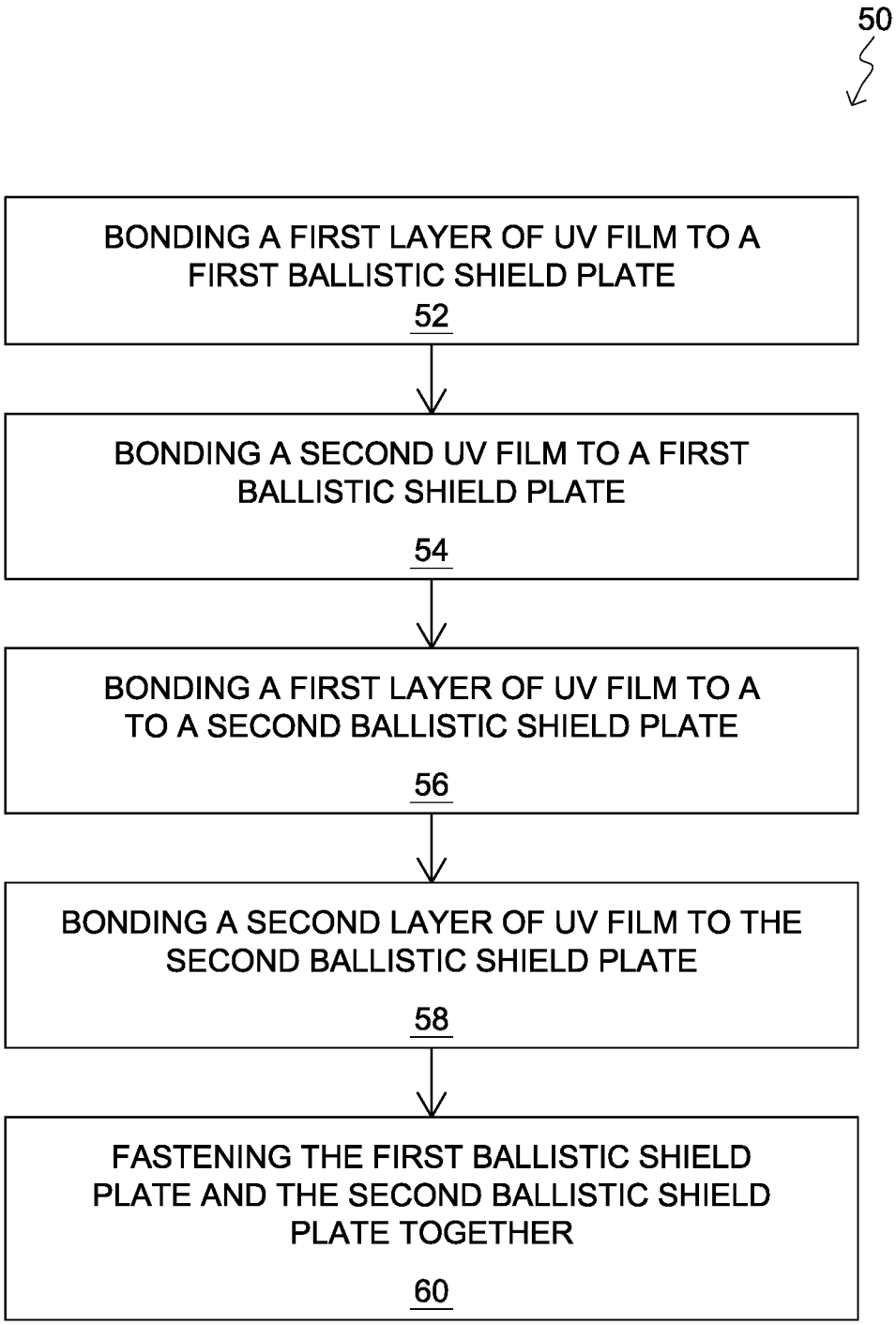
FIG. 7 is a flowchart showing a method of manufacture of a ballistic shield, according to one embodiment of the invention.

FIG. 7 is a flowchart showing a method of manufacture of a ballistic shield, according to one embodiment of the invention. There is shown a method of manufacture of a ballistic shield 50 that includes the step of incorporating a plurality of air pockets between the first and second double-layered UV protective film of the first and second ballistic shield plates 60.

According to one embodiment of the invention, there is a method of manufacture of a transparent ballistic shield 50. The method of manufacture 50 includes the step of bonding a first layer of UV protective film to a first ballistic shield plate 52. The method 50 also includes the step of bonding a second layer of UV protective film to the first layer of UV protective film of the first ballistic shield plate 54. The method of manufacture 50 includes the step of bonding a first layer of UV protective film to a second ballistic shield plate 56. The method 50 includes the step of bonding a second layer of UV protective film to the first layer of UV protective film of the second ballistic shield plate 58. The method of manufacture further includes the step of mechanically fastening the first and second ballistic shield plates to each other 60 such that the first doubled-layered UV protective film of the first ballistic shield plate is adjacent to the second double-layered UV protective film of the second ballistic shield plate; such that a plurality of air pockets are trapped between the first and second double-layered UV protective film of the first and second ballistic shield plates. The plurality of air pockets help dampen and spread the impact caused by a projectile or bullet hitting the ballistic shield.

According to one embodiment of the invention, there is a method of manufacture of a transparent ballistic shield 50 including the step of drilling a plurality of holes through the first ballistic shield plate and the second ballistic shield plate and fastening the shield plates together. The method of manufacture 50 includes the step of attaching a top support bracket and a bottom support bracket to the second ballistic plate to fasten the first ballistic shield plate to the second ballistic shield plate, wherein the top support bracket includes a handle. The method 50 includes the step of applying a scratch resistant UV protective film to an exterior surface of the first ballistic shield plate.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the first and second ballistic shield plates are bonded together to form a ballistic shield, one skilled in the art would be able to shape or mold the ballistic shield plates to form a variety of cases or shells to be incorporated in to different products. Examples are, but not limited to: backpacks, laptop cases, suitcases, cars, secured vehicles, windows, windshields, protection structures, protection barriers, protection vehicles.

Additionally, although the figures illustrate a ballistic shield, one skilled in the art would be able to include an attachment device, such as a Velcro strap, to secure an item for the carrier, such as but not limited to: a firearm, a flashlight, a knife, a weapon, etc.; and still perform it's intended function of protecting the carrier.

It is also envisioned that the ballistic shield may vary in size, shape, length, height, thickness and still perform it's intended function.

It is expected that there could be numerous variations of the design of this invention. An example is that the ballistic shield plates may be incorporated into a shell of a backpack, to protect the contents of the backpack and also protect the wearer of the backpack.

Finally, it is envisioned that the components of the device may be constructed of a variety of materials, such as but not limited to: polycarbonate, UV film, any strong lightweight metal, such as: aluminum, beryllium, titanium, and magnesium alloys Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A ballistic shield, comprising:

a) a first ballistic shield plate including a first double-layered UV protective film bonded to a first side and forming an exterior surface thereof;

b) a second ballistic shield plate having a first side, the first side coupled to the first side of the first ballistic shield plate, including a second double-layered UV protective film, bonded to a first side thereof and forming an exterior surface thereof; and c) a mechanical fastener fastening the first ballistic shield plate to the second ballistic shield plate such that the first double-layered UV protective film is fixedly coupled against the second double-layered UV protective film without requiring bonding therebetween.

2. The ballistic shield of claim 1, wherein the first ballistic shield and the second ballistic shield are transparent to light in the visible spectrum.

3. The ballistic shield of claim 1, further comprising a handle coupled to a top support bracket of the mechanical fastener.

4. The ballistic shield of claim 1, wherein the first ballistic shield plate is coupled to the second ballistic shield plate by fasteners extending through a plurality of holes through the first ballistic shield plate and the second ballistic shield plate that fastening a pair of support brackets to the second ballistic shield plate and the first ballistic shield plate.

5. The ballistic shield of claim 1, wherein the handle is oriented horizontally such that when grasped by a user a bottom support bracket rests on a forearm of a user.

6. The ballistic shield of claim 1, further comprising a scratch resistant UV film bonded to a second surface of the first ballistic shield plate and forming an exterior surface thereof.

7. The ballistic shield of claim 1, further comprising a plurality of air pockets disposed between the UV film of the first ballistic shield plate and the second ballistic shield plate.

8. A ballistic shield, comprising:

a) a first ballistic shield plate including a first double-layered UV protective film bonded to a first side and forming an exterior surface thereof;

b) a second ballistic shield plate having a first side, the first side coupled to the first side of the first ballistic shield plate, including a second double-layered UV protective film, bonded to a first side thereof and forming an exterior surface thereof; and c) a mechanical fastener fastening the first ballistic shield plate to the second ballistic shield plate such that the first double-layered UV protective film is fixedly coupled against the second double-layered UV protective film without requiring bonding therebetween.

9. The ballistic shield of claim 8, wherein the first ballistic shield and the second ballistic shield are transparent to light in the visible spectrum.

10. The ballistic shield of claim 9, further comprising a handle coupled to a top support bracket of the mechanical fastener.

11. The ballistic shield of claim 10, wherein the first ballistic shield plate is coupled to the second ballistic shield plate by fasteners extending through a plurality of holes through the first ballistic shield plate and the second ballistic shield plate that fastening a pair of support brackets to the second ballistic shield plate and the first ballistic shield plate.

12. The ballistic shield of claim 11, wherein the handle is oriented horizontally such that when grasped by a user a bottom support bracket rests on a forearm of a user.

13. The ballistic shield of claim 12, further comprising a scratch resistant UV film bonded to a second surface of the first ballistic shield plate and forming an exterior surface thereof.

14. The ballistic shield of claim 13, further comprising a plurality of air pockets disposed between the UV film of the first ballistic shield plate and the second ballistic shield plate.

15. A method of manufacture of a transparent ballistic shield, comprising the steps of a) bonding a first layer of UV film to a first ballistic plate;

b) bonding a second layer of UV film to the first layer of UV film of the first ballistic plate;

c) bonding a first layer of UV film to a second ballistic plate;

d) bonding a second layer of UV film to the first layer of UV film of the second ballistic plate; and c) mechanically coupling the first and second ballistic plates to each other such that the second layer of UV film of the first ballistic plate is adjacent to the second layer of UV film of the second ballistic plate and that air is trapped between the interface between the first and second ballistic plates.

16. The method of manufacture of a transparent ballistic shield of claim 15, further comprising the step of drilling a plurality of holes through the first ballistic plate and the second ballistic plate and fastening the plates together.

17. The method of manufacture of a transparent ballistic shield of claim 16, further comprising the step of attaching a top support bracket and a bottom support bracket to the second ballistic plate to couple the first ballistic shield plate to the second ballistic shield plate, wherein the top support bracket includes a handle.

18. The method of manufacture of a transparent ballistic shield of claim 17, further comprising the step of applying a scratch resistant UV film to an exterior surface of the first ballistic plate.

19. A ballistic shield, comprising:

a) a first ballistic shield plate including a first double-layered UV protective film bonded to a first side and forming an exterior surface thereof;

b) a second ballistic shield plate having a first side, the first side coupled to the first side of the first ballistic shield plate, including a second double-layered UV protective film, bonded to a first side thereof and forming an exterior surface thereof; wherein the first ballistic shield and the second ballistic shield are transparent to light in the visible spectrum;

c) a mechanical fastener fastening the first ballistic shield plate to the second ballistic shield plate such that the first double-layered UV protective film is fixedly coupled against the second double-layered UV protective film without requiring bonding therebetween; wherein the first ballistic shield plate is coupled to the second ballistic shield plate by fasteners extending through a plurality of holes through the first ballistic shield plate and the second ballistic shield plate that fastening a pair of support brackets to the second ballistic shield plate and the first ballistic shield plate;

d) a handle coupled to a top support bracket of the mechanical fastener; wherein the handle is oriented horizontally such that when grasped by a user a bottom support bracket rests on a forearm of a user;

c) a scratch resistant UV film bonded to a second surface of the first ballistic shield plate and forming an exterior surface thereof; and f) a plurality of air pockets disposed between the UV film of the first ballistic shield plate and the second ballistic shield plate; wherein the plurality of air pockets are formed during manufacture.

* * * * *